United States Patent [19]

Remis

[11] Patent Number: 4,574,990

[45] Date of Patent: Mar. 11, 1986

[54] CARRIER AND BAG ATTACHMENT FOR FOLDING STOOLS

[76] Inventor: C. Steven Remis, 9033 Holly, Kansas City, Mo. 64114

[21] Appl. No.: 575,143

[22] Filed: Jan. 30, 1984

[51] Int. Cl.[4] ..... A45F 5/00

[52] U.S. Cl. ..... 224/255; 224/155; 190/8

[58] Field of Search ..... 224/155, 255; 190/8; 297/159; 190/117, 110; 383/4

[56] References Cited

U.S. PATENT DOCUMENTS

| | | | |
|---|---|---|---|
| 168,402 | 10/1875 | Laumonier | 190/8 |
| 2,375,819 | 5/1945 | Reid | 190/8 |
| 2,843,185 | 7/1958 | Clem et al. | 224/155 |
| 2,982,455 | 5/1961 | Rosen | 224/155 |
| 3,692,358 | 9/1972 | Sung | 297/159 |

FOREIGN PATENT DOCUMENTS

| | | | |
|---|---|---|---|
| 108896 | 3/1900 | Fed. Rep. of Germany | 224/155 |
| 1194851 | 6/1970 | United Kingdom | 224/155 |

*Primary Examiner*—Stephen Marcus

*Assistant Examiner*—David Voorhees

*Attorney, Agent, or Firm*—Kokjer, Kircher, Bradley, Wharton, Bowman & Johnson

[57] ABSTRACT

A device which serves as a carrier for a folding stool and as a compartmented bag for holding articles. A flexible fabric body has opposite sides which cover leaves on opposite sides which cover leaves on opposite sides of the folded stool, and a top connecting strip which interconnects the sides of the folded stool, and a top connecting strip which interconnects the sides and covers the top edge of the stool. Snap fasteners on the lower edges of the sides can be connected beneath the leaves to secure the carrier on the stool. The carrier and stool can be carried by a handle, or by a strap which can be connected to serve as a shoulder strap, or by strapping the carrier and stool on the back in the manner of a backpack. Compartments on the opposite sides of the fabric body can hold various objects and can be closed by zipper fasteners. A smaller pocket is formed on one of the sides, and the other side has an adjustable sleeve for holding umbrellas and other long articles.

15 Claims, 2 Drawing Figures

CARRIER AND BAG ATTACHMENT FOR FOLDING STOOLS

BACKGROUND OF THE INVENTION

This invention relates to a bag arrangement which functions both to hold articles and as a carrier for a portable folding stool.

Folding stools of the type shown in U.S. Pat. No. 2,587,010 to R. W. Thompson have proven to be useful in a wide variety of applications, primarily because of the convenience resulting from the portability of the stool and the quick and easy manner in which it can be folded and unfolded. For example, this type of stool is commonly used by campers, hunters, fishermen, vacationers, shoppers, swimmers, parade watchers, and by persons attending athletic events such as football games, baseball games, golf tournaments, tennis matches, soccer games and other sports activities. In addition to providing a portable seat, the stool can also serve as a table or tray for holding various items.

In many cases, carrying of the stool by hand presents no great problem because of its relatively small size and light weight. However, it is common for the stool to be carried at the same time as various other items such as a purse, a camera, camping equipment, tools, towels and other articles used by swimmers, binoculars, hunting or fishing equipment, and athletic gear or clothes. In these instances, it is highly desirable to provide a more convenient way for the stool and the other objects to be carried.

SUMMARY OF THE INVENTION

The present invention is directed to a bag structure which serves the combined function of a carrier for the folding stool and a compartmented bag for holding a wide variety of articles. In accordance with a preferred form of the invention, the combined carrier and bar is formed from flexible fabric, and it can be applied to the folded up stool. The fabric body covers the opposite sides of the stool and extends over its top, and snap fasteners are provided at the bottom so that it can be easily and securely attached to the stool. The bag and stool can be carried together by a handle, or by means of an adjustable shoulder strap which has the advantage of leaving both hands free. Alternatively, the bag and stool can be carried in the style of a backpack with both arms extended through straps to mount it on the back. Again, both hands remain free for other activities.

Large capacity bag compartments are built into the opposite sides of the carrier to receive and hold a variety of articles such as athletic gear, tools, camping gear, clothes, hunting and fishing gear, camera equipment, items of the type normally carried in a purse, and virtually any other object which will fit in one of the bag compartments. A smaller pocket compartment may be provided on one side of the carrier to hold smaller items such as keys, money, sunglasses, film, cameras, binoculars and the like. A sleeve which is open at both ends may be provided on one side of the carrier to hold an umbrella, a tennis racket or another type of racket, or any other long object. The sleeve is adjustable and can be tightened on the articles it receives in order to hold them in place.

It is the primary object of the invention to provide a combined stool carrier and bag which facilitates carrying of a folding stool and at the same time holds a wide variety of articles.

Another object of the invention is to provide a stool carrier and bag which can be carried in the hand by means of a handle, at the side by the means of a shoulder strap, or on the back in the manner of a backpack.

A further object of the invention is to provide a stool carrier and bag which includes a plurality of separate compartments having different sizes and shapes to conveniently hold various types of articles, including sports gear, camera equipment, hunting and fishing gear and other items. The adjustable sleeve on one side of the carrier is important in this respect in that it permits the convenient carrying of elongated objects such as umbrellas, tennis rackets and other long handled articles. The relatively deep pocket on the opposite side has a size and depth to hold binoculars, cameras and similarly sized items.

An additional object of the invention is to provide a stool carrier and bag which can be quickly and easily applied to and removed from a folding stool.

Yet another object of the invention is to provide a stool carrier and bag of the character described which is highly versatile and useful in a wide variety of applications.

A still further object of the invention is to provide a carrier and bag of the character described which is well suited to display advertising material such as company logos in an attractive manner.

Other and further objects of the invention, together with the features of novelty appurtenant thereto, will appear in the course of the following description.

DETAILED DESCRIPTION OF THE INVENTION

Figure 1:
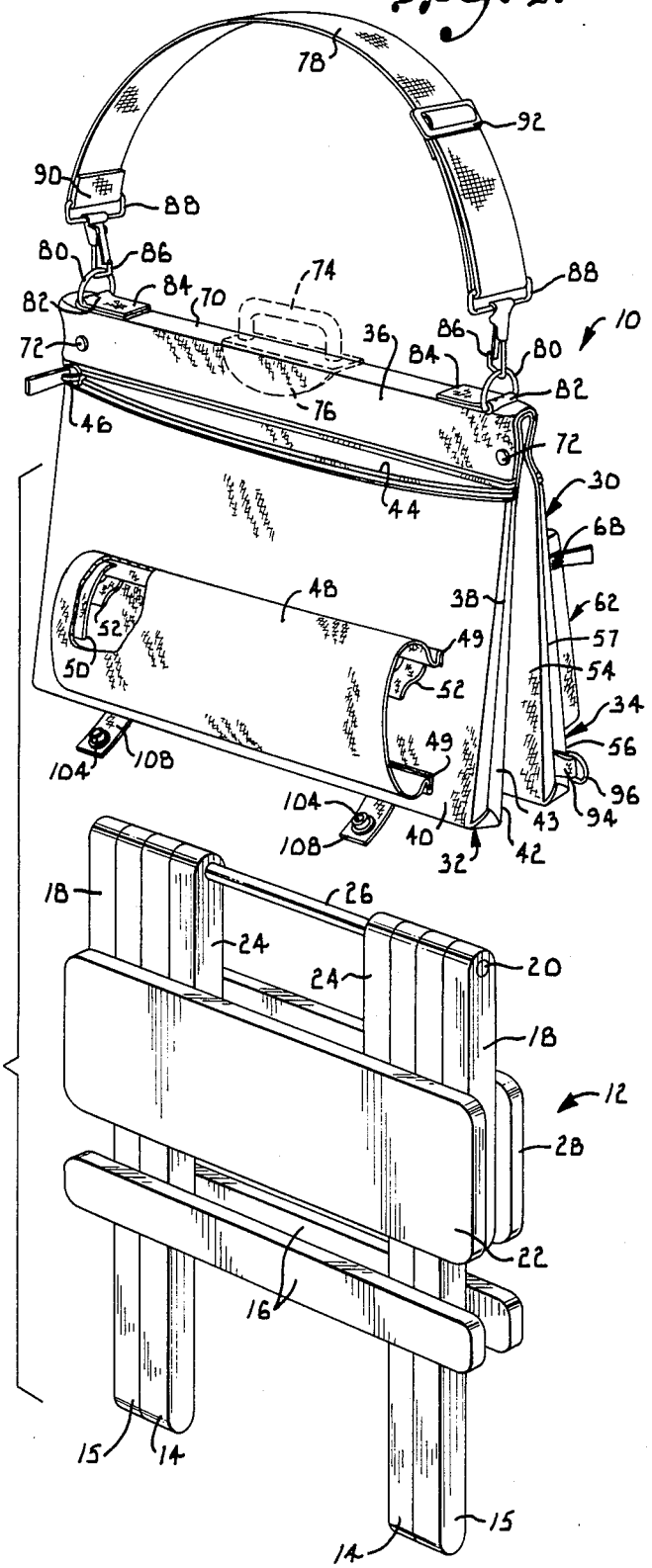
Figure 2:
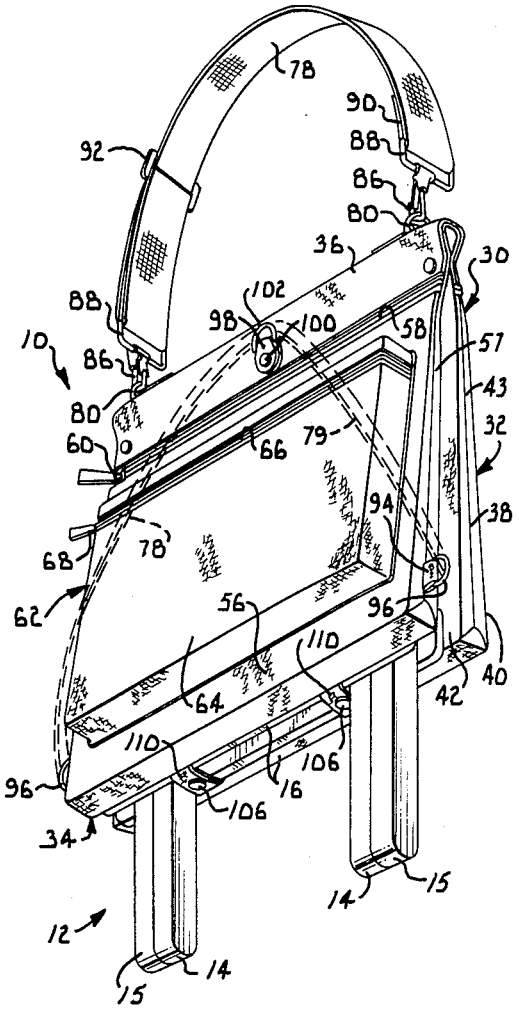

In the accompanying drawing which forms a part of the specification and is to be read in conjunction therewith and in which like reference numerals are used to indicate like parts in the various views:

FIG. 1 is an exploded perspective view showing a folded stool and a bag and carrier device constructed according to a preferred embodiment of the present invention, with a portion of the sleeve on one side of the bag broken away for purposes of illustration; and FIG. 2 is a perspective view showing the bag and carrier applied to the folded stool, taken from the side opposite that visible in FIG. 1.

Referring now to the drawing in more detail, the present invention provides a bag and carrier device 10 for use with a folding stool such as the stool generally designated by numeral 12 in FIG. 1. The stool 12 may be of the same general type shown in U.S. Pat. No. 2,587,010 to R. W. Thompson, which is incorporated herein by reference in its entirety.

The stool 12 is shown in its folded condition in FIG. 1. It includes four stool legs, a pair of inside legs 14 and a pair of outside legs 15 which extend side by side with the inside legs 14 when the stool is in the folded condition. Each pair of adjacent legs 14 and 15 is connected near the midpoint of each leg by a pivot pin (not shown) so that when the stool is unfolded, each pair of legs 14 and 15 forms an X shaped configuration. Leg braces 16 located on opposite sides of the folded stool extend between the pairs of legs 14 and 15.

A pair of outside cleats 18 are connected pivotally with the upper ends of the outside legs 15 by horizontal pivot pins 20. Extending rigidly between and secured to the opposite or lower end portions of the cleats 18 is a flat leaf 22 which forms one half of the seat of the stool when same is unfolded. A pair of inside cleats 24 are pivotally connected with the upper ends of the inside legs 14 by a horizontal dowel or rod 26. Secured to the cleats 24 is another flat leaf 28 which is identical to leaf 22 and which cooperates therewith to form the stool seat in the unfolded set up position of the stool.

The manner in which the stool 12 is folded and unfolded is disclosed in the aforementioned Thompson U.S. Pat. No. 2,587,010, to which reference can be made for a more detailed understanding of the construction of the stool and the manner in which it folds and unfolds. In the folded or carrying condition of the stool shown in FIG. 1, the leaves 22 and 28 are located parallel to one another on opposite sides of the stool well below the upper end formed by the top ends of the legs 14 and 15 and cleats 18 and 24. The leg braces 16 are spaced above the lower ends of the stool legs and are spaced somewhat below and in the same vertical planes as the leaves 22 and 28.

In accordance with the present invention, the carrier and bag device 10 can be applied to the folded up stool 12 in order to serve as a carrier for the stool and also as a bag which can hold a wide variety of articles. The bag and carrier 10 has a flexible body 30 which may be formed of any flexible fabric such as denim or cotton or a synthetic fabric such as nylon, or any other suitable material. The fabric body 30 includes opposite sides 32 and 34 which are interconnected at their top portions by a connecting strip 36 but are free from one another along the sides. The body 30 is preferably formed by two panels of material which are stitched together along their edges as indicated by the stitch line 38. Side 32 is thus formed by a pair of panels 40 and 42 which are stitched together along their sides and are joined at the bottom to present a compartment 43 for holding articles between the panels 40 and 42. Preferably, the side and bottom edges of side 32 are pleated so that the compartment 43 formed between panels 40 and 42 can be expanded when articles are deposited therein.

A slit 44 located adjacent to the top connecting strip 36 provides an access opening to the compartment 43. The slit 44 is formed through the outer panel 40. A conventional zipper fastener 46 serves to open and close the slit 44 in order to respectively expose and enclose the contents of the compartment 43.

With continued reference to FIG. 1, a fabric sleeve 48 is secured to the outer fabric panel 40 on the side 32 of the bag. Sleeve 48 has edges 49 which are overlapped and secured to the outside surface of panel 40, as by stitching. The sleeve 48 is open at both ends and provides a horizontal tube container for receiving and holding elongate articles such as umbrellas, tennis racket handles, and other long handled objects.

The size of the tube-like passage which extends through sleeve 48 can be adjusted so that the sleeve can be tightened on the objects which it receives. A pair of fabric strips 50 are secured to the inside surface of sleeve 48 adjacent its opposite ends. Shorter fabric tabs or strips 52 are secured to the face of panel 40 at locations to confront the strips 50. The pairs of strips 50 and 52 are provided with mating fasteners (which may be Velcro fasteners) so that the strips adhere to one another when pressed together. The strips 50 are substantially longer than strips 52, and the effective size presented within the sleeve 48 depends upon the areas of strips 50 which are pressed against the mating strips 52. The maximum size of the sleeve is presented when the strips 50 and 52 are separated. The minimum size is presented when the lower end portions of strips 50 are pressed against strips 52. In this manner, sleeve 48 can be pulled tightly around objects it receives, and the strips 50 can then be pressed against strips 52 to tighten the sleeve on the object.

Side 34 of the bag is virtually identical to side 32 and includes a pair of opposed panels 54 and 56 which are connected along their side edges (by stitching 38) and along the bottom edge to provide a compartment 57 for receiving and holding objects. Again, the edges may be pleated so that the compartment 57 is expandable.

As shown in FIG. 2, a horizontal slit 58 is formed through the outer panel 56 to provide an access opening to the compartment 57 formed between panels 54 and 56. The access slit 56 may be opened and closed by a conventional zipper fastener 60. It should be pointed out that the zippers 46 and 60 can be replaced by flaps which can be closed over the access openings 44 and 58 by suitable fasteners (such as Velcro strips).

The outer panel 56 on side 34 of the bag is provided with a pouch like pocket 62. The pocket 62 is formed by a fabric panel 64 which is stitched or otherwise secured along all of its edges to panel 56. The pocket which is presented between panels 64 and 56 is somewhat smaller than the compartments formed on the opposite sides of the bag between panels 40 and 42 and panels 54 and 56, although it is deeper to permit it to hold objects such as binoculars and cameras. The pocket 62 is also suitable for receiving other types of articles. Access to the interior of the pocket 62 is provided by a horizontal slit 66 which is formed through panel 64 on its upper portion. A conventional zipper fastener 68 serves to open and close the slit 66. Again, a flap or other closure means can be provided for the slit 66.

The sides 32 and 34 of the bag are large enough to completely cover the leaves 22 and 28 and the leg braces 16 of the stool, as best shown in FIG. 2.

The connecting strip 36 which forms the top portion of the bag and carrier 10 interconnects the opposite sides 32 and 34 and is formed by a double ply of the fabric of which the bag is constructed. The connecting strip 36 extends upwardly from the access openings 34 and 58 and includes a generally horizontal top surface 70 having sufficient breathe to span a distance between the opposite sides of the folded stool. When the carrier is applied to the stool, the sides 32 cover the leaves and leg braces on opposite sides of the stool, and the top surface 70 covers and extends over the top edge portion of the stool.

The opposite sides of the connecting strip 36 are interconnected near their side edges by rivets 72 or other fasteners. If desired, the rivets 72 can be replaced by snap type fasteners (not shown) which are detachable. A handle 74 (shown in broken lines in FIG. 1) can be provided on the top surface 70 of connecting strip 36 so that the bag and stool can be carried by hand. Alternatively, the opposite sides and top of the connecting strip can be cut away, such as along the broken line 76, so that the central portion of the rod 26 is exposed through the cut away portion of the strip. Then, the rod 26 can serve as a handle by which the unit can be carried.

The bag is also equipped with a shoulder strap 78. The opposite ends of the shoulder strap 78 may be connected with metal rings 80 which extend through sleeve portions 82 of a pair of patches 84. The patches 84 are stitched or otherwise suitably secured to the top surface 70 of the connecting strip 36.

The opposite ends of the shoulder strap 78 carry releasable hook fasteners 86 which may be fastened to the rings 80. The hooks 86 are carried on metal bails 88, one of which extends through a loop 90 formed on one end of the strap 78. The opposite end portion of the strap is looped through the other bail 88 and secured to an adjustment buckle 92. The shoulder strap 78 is threaded through the buckle 92, and the buckle may be adjusted along the shoulder strap in order to vary the strap length. In this manner, the length of the shoulder strap can be adjusted to accommodate the individual using it.

In addition to being carried by the handle 74 (or rod 26) or over the shoulder by the shoulder strap 78, the bag and carrier can be carried in the style of a backpack. A pair of fabric loops 94 are secured to the opposite side edges of side 34 near the lower end of the bag. Each loop 94 receives a metal ring 96. Another fabric (or leather) loop 98 is secured by a rivet 100 or another fastener to one side of the connecting strip 36 at a location above slit 58. A metal ring 102 extends through the loop 98. The hook fasteners 86 can be detached from rings 80, and one of them can be attached to one of the rings 96 and the other to the ring 102. Another shoulder strap 79, identical to strap 78, can then have the hook on one of its ends fastened to the other ring 96 and the hook on its opposite end fastened to ring 102. The straps are then in the broken line position shown in FIG. 2, and their lengths can be adjusted as desired by properly adjusting the buckles 92. The bag and stool can be applied to the back and carried backpack style by extending the arms through the straps 78 and 79.

The opposite sides 32 and 34 of the bag can be connected at their lower edges by a pair of snap fasteners each having a male fastener 104 (FIG. 1) and a female fastener 106 (FIG. 2). The male fasteners 104 are carried on fabric strips 108 which extend below the lower edge of side 32. The female fasteners 106 are carried on fabric strips 110 which extend below the lower edge of the opposite side 34.

In use, the bag and carrier device 10 can be applied to the folded up stool 12 by lowering the bag over the top of the stool. The opposite sides 32 and 34 cover the leaves 22 and 28 and the leg braces 16 on the opposite sides of the stool, and the connecting strip 36 extends over and spans the upper edge of the stool. The sides 32 and 34 extend slightly below the leg braces 16 and can be connected with one another by the snap fasteners 104 and 106 to secure the bag in place on the stool. The fabric strips 108 and 110 cooperate to extend beneath the lower edges of the leg braces 16 inwardly of the stool legs 14 and 15, as shown in FIG. 2.

After the carrier has been applied to the stool in this manner, the carrier and stool can be carried together by grasping the handle 74 (or rod 26). Alternatively, the carrier and stool can be carried at the side by extending one arm through the shoulder strap 78. Another alternative is to carry the unit in backpack style by attaching the straps 78 and 79 in the manner shown in broken lines in FIG. 2. By carrying the unit on the shoulder or back, both hands are free for other activities, while use of the handle 74 (or rod 26) requires the use of one hand.

The device 10 also serves as a bag in which various articles can be carried. The compartments 43 and 57 on the opposite sides of the bag can receive articles such as tools, cameras, hunting gear, fishing gear, camping equipment, sports gear, clothes, binoculars, towels and other articles used by swimmers, and items of the type normally carried in a purse such as keys, money, sunglasses, checkbooks and the like. Such articles can also be carried in the pouch like pocket 62 formed on one side of the bag. As previously indicated, umbrellas, tennis rackets and other elongated objects can be carried in the sleeve 48 and secured by tightening the sleeve.

It should be noted that the device 10 can take various forms. For example, it can be provided on its lower portion with legs (not shown) which fit over the folded legs 14 and 15 of the stool 12. In this instance, the device 10 will be constructed to slip onto the bottom of the stool, and it will be equipped with fasteners for fastening it over the top of the stool. A cartoon character face can be provided on each side 32 and 34 of the bag so that the bag has the appearance of a cartoon character with legs for the amusement of children.

Another alternative is to construct the bag such that it can be wrapped around the stool beneath the leaves 22 and 28 (and possibly the leg braces 16 also) and fastened at the top by a fold over flap having fasteners (such as Velcro fasteners) for holding the flap closed.

Another alternative is to construct the bag in a manner permitting it to function as a saddle bag when detached from the stool 12. In this construction, flat cushions can be sewn into the lining of the bag on its opposite sides. The cushions provide padding which can be applied to the stool seat to pad it, and which can be otherwise used as a cushion.

It is contemplated that the exposed surfaces of the bag and carrier device 10 can be provided with advertising materials such as company logos and promotional slogans, as well as other artistic or written material. The large surfaces on the opposite sides of the bag are well suited for this purpose. Another option is to provide a radio (not shown) which can be clipped or otherwise detachably connected with the handle or rod 26.

It is contemplated that the bag and carrier device, along with the stool 12, will be used in a wide variety of applications such as camping, fishing, hunting, vacation trips, parades, shopping, and attendance at sporting events such as football games, baseball games, soccer games, tennis matches, golf tournaments and other athletic contests. The equipment and accessories needed for each application can be conveniently carried in the various compartments and pockets of the bag.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A carrier and bag attachment for a folding stool having a folded condition in which a pair of generally flat, rigid seat leaves are located on opposite sides of the stool and an unfolded condition in which the leaves cooperate to form a rigid horizontal seat for the stool supported on legs, said attachment comprising:

a flexible fabric body adapted to be applied to the stool to serve as a carrier therefor when the stool is in the folded condition;

a pair of opposite side portions of said fabric body substantially covering the leaves of the stool on the opposite sides thereof when said fabric body is applied thereto;

a connecting strip portion of said fabric body interconnecting said side portions thereof and spanning the distance between the leaves of the stool when said fabric body is applied thereto;

a compartment on each of said side portions of the fabric body for receiving and holding articles, each compartment being accessible when the fabric body is applied to the stool in the folded condition thereof;

releasable fastening means having a fastened condition for connecting said side portions together at a location beneath the leaves in a manner to secure said fabric body on the stool in the folded condition thereof with said side portions covering the leaves and said connecting strip portion spanning the leaves to thereby permit the stool to be carried in the folded condition by said fabric body, said fastening means being releasable to release said fabric body from the stool for complete removal therefrom to free the stool so that the stool can be set up in the unfolded condition for use with said fabric body completely detached from the stool; and said compartments each being accessible to provide access to the articles in the compartments when said fabric body is applied to the stool in the folded condition thereof and said fastening means is in the fastened condition to secure said fabric body on the stool, said fabric body holding the stool in the folded condition thereof when said fastening means is in the fastened condition to thereby require removal of the fabric body from the stool before the stool can be set up in the folded condition.

2. The invention of claim 1, including handle means on said fabric body to facilitate carrying of the fabric body and stool together.

3. The invention of claim 1, including shoulder strap means on said fabric body to facilitate carrying of the fabric body and stool together.

4. The invention of claim 1, including strap means on said fabric body for strapping the fabric body and stool onto the back for carrying thereon.

5. The invention of claim 1, wherein each compartment is formed between a pair of fabric panels on said opposite side portions of the fabric body, said fabric panels being joined along edge portions thereof to enclose each compartment between the corresponding panels.

6. The invention of claim 5, including:

an access opening in one of the fabric panels in each pair providing access to the corresponding compartment for the introduction and removal of articles; and means for opening and closing each access opening.

7. The invention of claim 5, including a sleeve on one of said fabric panels open on opposite ends for receiving and holding elongate articles.

8. The invention of claim 7, including means for adjusting the size of said sleeve to tighten same on the articles received in the tube container.

9. A combined folding stool structure and carrier and bag device therefor comprising:

a folding stool having a plurality of legs and a pair of generally flat rigid leaves, said stool having a folded condition wherein the leaves are located on opposite sides of the stool and are generally parallel and an unfolded condition wherein the leaves are generally coplanar and cooperate to form a rigid horizontal seat for the stool supported on said legs;

a flexible fabric body adapted to be applied to the stool to serve as a carrier therefor when the stool is in the folded condition, said fabric body having a pair of opposite sides covering the leaves of the stool when the fabric body is applied thereto;

a pair of connected fabric panels forming each of the opposite sides of said fabric body, each pair of panels being connected along edge portions thereof to present an enclosed compartment for holding articles between each pair of fabric panels;

an access opening for each compartment providing access thereto for the introduction and removal of articles;

a connecting top portion of said fabric body extending between said opposite sides of the body, said connecting top portion of the fabric body spanning the top of the stool when the body is applied thereto;

releasable fastening means having a fastened condition for connecting said opposite sides of the fabric body at a location beneath the leaves to secure said body on the stool in a manner to hold the stool in the folded condition thereof with said opposite sides of the body covering the leaves and said connecting top portion spanning the top of the stool to thereby permit the stool to be carried with said fabric body, said fastening means being releasable to permit said fabric body to be completely detached from the stool so that same can be set up in the unfolded condition thereof, each of said access openings being accessible when the fastening means is in the fastened condition to secure said fabric body on the stool in the folded condition thereof; and a carrying member on said top portion of the fabric body to facilitate carrying of said body and the stool.

10. The invention of claim 9, wherein said carrying member comprises a shoulder strap.

11. The invention of claim 9, including a pocket on the exterior of one of the fabric panels on one side of the fabric body for receiving and holding articles and a sleeve on the exterior of one of the fabric panels on the other side of the fabric body, said sleeve having open opposite ends for receiving and holding elongate articles.

12. A combination folding stool structure and bag carrier therefor comprising:

a folding stool having a plurality of legs and a pair of generally flat rigid leaves, said stool having a folded condition wherein the leaves are located on opposite sides of the stool and are generally parallel and an unfolded condition wherein the leaves are generally coplanar and cooperate to form a rigid horizontal seat for the stool supported on said legs;

a flexible fabric body having opposite sides which are interconnected at upper edge portions thereof by a strip portion of the body, each side having opposite side edge portions and a lower edge portion and each side having a size to cover one leaf of the stool when said body is applied thereto in the folded condition of the stool;

said strip portion of the fabric body extending over the upper ends of the stool legs to span the top of the stool when said body is applied thereto in the folded condition of the stool;

at least one compartment for holding articles on each side of said body;

releasable fastening means having a fastened condition for connecting the lower edge portions of said sides at a location beneath the leaves of the stool, thereby securing said body on the stool to serve as a carrier therefor and to hold the stool in the folded condition thereof with said compartments being accessible in the fastened condition of said fastening means so that the articles are accessible, said fastening means being releasable to permit said fabric body to be completely detached from the stool so that same can be set up in the unfolded condition; and a carrying member on said strip portion of the fabric body to facilitate carrying of the fabric body and stool together.

13. The invention of claim 12, including a sleeve on the exterior of the compartment on one side of said fabric body for receiving and holding elongate articles.

14. The invention of claim 13, including means for adjusting the effective size of said sleeve to tighten same on the articles received in the sleeve.

15. The invention of claim 12, including a pocket on the exterior of the compartment on the other side of said fabric body for receiving and holding articles.

* * * * *